US005882732A

United States Patent [19]

Barbee et al.

[11] Patent Number: 5,882,732

[45] Date of Patent: Mar. 16, 1999

[54] HORIZONTALLY CHILL-SETTING A DOWNWARDS FACING LIQUID PHOTOGRAPHIC MATERIAL

[75] Inventors: Eugene Hartzell Barbee; John Dallas Lang; Gifford James Lewis; William Arthur Torpey, all of Rochester, N.Y.

[73] Assignee: Eastman Kodak Company, Rochester, N.Y.

[21] Appl. No.: 955,671

[22] Filed: Jun. 29, 1992

Related U.S. Application Data

[63] Continuation of Ser. No. 703,542, May 21, 1991, abandoned.

[51] Int. Cl.[6] ..... B05D 1/26; B05D 3/12

[52] U.S. Cl. ..... 427/398.1; 427/402; 427/420; 118/69; 118/DIG. 4

[58] Field of Search ..... 427/398.1, 377, 427/420, 402; 118/DIG. 7, 69, DIG. 4

[56] References Cited

U.S. PATENT DOCUMENTS

| | | | |
|---|---|---|---|
| 1,392,498 | 10/1921 | Heppes et al. | 427/398.1 |
| 1,699,349 | 1/1929 | Dailey . | |
| 2,168,051 | 8/1939 | Smith et al. | 91/69 |
| 2,229,401 | 1/1941 | Worm, Jr. | 154/28 |
| 3,265,034 | 8/1966 | Di Mino | 118/68 |
| 3,362,374 | 1/1968 | Greiller | 117/34 |
| 3,508,947 | 4/1970 | Hughes | 117/34 |
| 3,867,901 | 2/1975 | Greiller | 118/50 |
| 4,051,278 | 9/1977 | Democh | 427/326 |
| 4,173,924 | 11/1979 | Bradshaw | 98/115 SB |
| 4,287,240 | 9/1981 | O'Connor | 427/402 |
| 4,313,980 | 2/1982 | Willemsens | 427/402 |
| 4,415,610 | 11/1983 | Choinski | 427/372.2 |
| 4,548,837 | 10/1985 | Yoshino et al. | 427/209 |
| 4,569,863 | 2/1986 | Koepke et al. | 427/402 |
| 4,663,198 | 5/1987 | Norris | 427/264 |
| 4,938,835 | 7/1990 | Ludwig | 156/555 |
| 5,114,759 | 5/1992 | Finnicum et al. | 427/420 |

FOREIGN PATENT DOCUMENTS

| | | |
|---|---|---|
| 0 197 493 A3 | 10/1986 | European Pat. Off. . |
| 56867 | 4/1980 | Japan . |

*Primary Examiner*—Katherine A. Bareford
*Attorney, Agent, or Firm*—Carl F. Ruoff; Arthur H. Rosenstein

[57] ABSTRACT

Method and apparatus are described for setting liquid photographic materials which have been applied as a coating on a support web, while the coated web is moving substantially horizontally with the liquid materials on the underside of the web. Chilling of the liquid materials may be commenced while the web is moving upwards or downwards after coating, but any setting is not permitted to occur until the web has been turned to move substantially horizontally with the liquid materials on the underside. In this way, gravity and surface tension forces act in opposition to one another where the coating lies adjacent surface non-uniformities in the web and tend to retain the uniformity of coating thickness achieved at the time of coating.

12 Claims, 9 Drawing Sheets

HORIZONTALLY CHILL-SETTING A DOWNWARDS FACING LIQUID PHOTOGRAPHIC MATERIAL

This is a Continuation of application Ser. No. 703,542, filed May 21, 1992, now abandoned.

FIELD OF THE INVENTION

This invention relates to manufacturing coated photographic materials such as, for example, photographic film and print paper.

BACKGROUND OF THE INVENTION

It is known that coated photographic materials, such as sensitized photographic film and print paper, are manufactured by coating extremely thin layers of material, in liquid form, onto a continuous web, sometimes termed a support. The support may be formed, for example, of a film of cellulose acetate or polyethylene terephthalate, or paper. The liquid coating is dried and the dried material is wound up prior to being unwound for, in some instances, having a further coating applied thereto, and, in other instances, cutting into strip or sheet form and for other "finishing" operations.

Sensitized photographic materials have to be manufactured to very small tolerances. The liquid material has to be applied to the web with a very high degree of thickness uniformity, both laterally and longitudinally of the web. Once the liquid material has been applied to the web with a very high degree of thickness uniformity, that uniformity has to be maintained up to the time the material is no longer fluid. In any photpgraphic manufacturing process which is commercially acceptable, the coating has to be performed at speeds as high as hundreds of feet per minute, for example, 500 feet per minute. To add to the difficulties of producing flaw free product, the viscosities of the liquid materials coated on the web are relatively low, such as, of the order of 10 to 40 cp, and hence the liquid materials flow readily under gravity or forces resulting from surface tension imbalance.

The step of drying the coated liquid material requires the application of much heat and the withdrawal of much evaporated liquid. These two requirements are best fulfilled by directing heated air at the coated layer. The heat evaporates the liquid and the air flow takes the evaporated liquid away. However, directing air flow at a liquid surface tends to deform the surface in at least two ways. Firstly, there is physical deformation due to non-uniform impingement of air and, secondly, there are random regions of surface tension differential due to uneven cooling which, in turn, is due to non-uniform impingement of air. These physical forces can deform the surface of the liquid coating to an extent which would be unacceptable in a sensitized photographic product if the deformations persisted into the product. Those skilled in the art know that if the thickness of a material in the coating varies so does the density of the photographic image created after exposure and processing of the material.

The photographic manufacturing industry has largely solved the problems associated with blowing drying air against a liquid layer on a web by causing the layer to gel or set before directing flows of drying air against the coating. The liquid materials coated onto a support usually include a binder material as well as other materials, such as silver halide, which play roles in the chemical reactions involved in the image making process. The binder material becomes a semi-rigid solid or gel when the coating is heated or cooled. In cases wherein the binder is gelatin, it is caused to set by chilling. In the set condition of the coated layer, the drying air flows can safely be directed at the coated layer without adverse effect on the thickness uniformity of the layer.

It will be understood that the chilling operation, being unlike the drying operation because there are not the large volumes of evaporated liquid to be removed, can be performed without directing air flow at the liquid coating. Chilling is often performed by directing chilled air at the uncoated side of the web and/or by passing the uncoated side of the web in contact with chilled rollers.

However, while the photographic manufacturing industry has largely solved the problems of drying a coating without the drying air itself adversely affecting the thickness uniformity of the coated layer, there is one problem which remains to be solved. This problem derives from any non-planarity there may be in the surface of the web onto which the layer of liquid material is coated. While the lack of planarity of the surface is usually acceptable from the viewpoint of its disturbing an image or object plane, it is only so acceptable if it does not adversely affect the uniformity of thickness of the coating. In other words, such lack of planarity is acceptable if the coated layer lies with uniform thickness on the surface and follows its imperfections. The height of the surface imperfections of the web being considered here are of a scale approaching microscopic and may be due, for example, to cross streaks, or the like, in cellulose acetate or polyethylene terephthalate support. For example, a frequent source of surface imperfections results from pulses in pressure in the feed of dope to the casting die when making cellulose acetate film to be used as support. Of course, every endeavor is made to produce supports with planar surfaces for receiving coatings. However, there is a practical limit to the planarity that can be achieved and to success in avoiding random occurrences which produce random defects in planarity.

The photographic industry is well able to apply liquid coatings which have uniform thickness both laterally and longitudinally of the support. However, until the liquid layer is set by chilling, there is the opportunity for forces such as gravity and surface tension to affect adversely the thickness uniformity which was achieved in the actual act of applying the liquid material to the web.

Let it be assumed that after coating with a layer of uniform thickness and before setting, the coated web is moving horizontally with the liquid coating facing upwards. If the web surface has imperfections in planarity, then, immediately after coating, the liquid-to-air surface, the free surface, of the coating exactly mimics the surface of the web immediately beneath it. Thus, there are pressure imbalances in the liquid layer due to the liquid-to-air surface not being planar. Gravity tends to reduce such imbalances in pressure in the liquid and, in so doing, causes flow which tends to level the surface of the liquid layer. There is flow away from over a high spot of the web surface towards an adjacent lower area of the web surface. Such flow causes loss of the thickness uniformity achieved at the time of application of the liquid material to the web.

There is a further physical phenomenon which is also in play, and this is surface tension. As is known, surface tension tends to oppose deformation of a liquid surface from a planar condition. Thus, with the coating liquid on top of a horizontal web which has imperfections in surface planarity, with the surface of the coating resembling the surface of the underlying web, as is the case if the coating has uniform thickness, surface tension is tending to level the surface.

Thus, in known arrangements in which the liquid coating is on the upper side of the web for chilling and setting, both surface tension and gravity are tending to work together to destroy the thickness uniformity achieved at the time of coating.

It is an object of the present invention to overcome the problems described above which are caused by flow of the liquid material on the web caused by imperfections in the planarity of the web surface.

SUMMARY OF THE INVENTION

The present invention overcomes the problems of the prior art by setting the liquid material coated onto the web while the coated web is moving substantially horizontally with the liquid material on the underside of the web. By having the liquid material on the underside of the web, the effects of gravity and of surface tension oppose one another. Gravity tends to make the liquid flow to under the "high" spots on the web surface and surface tension is tending to level the surface. (A "high" spot on the underside of a web is a spot which projects downwardly below the intended planar surface of the web). Any surfactant present modifies the surface tension and thus might change the levelling effect. By putting the effects of gravity and of surface tension into opposition, a more uniform thickness of the coating in the product may be achieved.

It is stated herein that setting of the liquid photographic materials on the web is accomplished by chilling while the web is moving substantially horizontally with the liquid materials on the underside thereof, that is, the liquid materials are facing downwards. It is to be understood that the terms substantially horizontal and substantially horizontally as used herein in this context are to be understood as meaning that the web is moving horizontally or at such an inclination to the horizontal that as setting of the liquid photographic materials begins, that is, as some portions of the photographic materials lose mobility, there are no unacceptable problems resulting from gravity induced flow of those portions of the photographic materials which are still mobile relative to those portions which have set and thereby lost their mobility. The maximum angle of inclination to the horizontal which may be employed while still producing acceptable product and reaping the benefits of the present invention varies from product to product depending on many parameters which will occur to those skilled in the art. It is believed that for some products an angle of inclination of 20° to the horizontal may be acceptable. Many products will be satisfatory if the angle is 10° or less and most products will be fully acceptable if the inclination is 5° or less.

There are two common ways of coating liquid photographic materials onto a web. One is known as bead coating and the other is known as curtain coating. These two coating methods are so well known that an overall description of them will not be given herein. In both coating methods, the liquid material is usually applied to the web when the web is supported by a support roller.

In known bead coating operations, the coated web is led either generally horizontally away from the support roller with the coating on top, or is led upwards and then turned to the horizontal with the coating on top. Chilling, setting and drying of the coated web have been conducted in such horizontal orientation, with the coating on top. The present invention may be employed in the bead coating context by leading the coated web either horizontally away from the support roller, or upwards, and then turning it so that it moves downwards. The coating is chilled while so moving downwards and chilling is continued, and setting caused, after the coated web has been turned so that it moves substantially horizontally with the coating facing downwards.

In known curtain coating operations, the coated web has been led either downwards away from the support roller and turned, with the web thereafter being horizontal and the coating being on the underside of the web, or has been led directly horizontally from the underside of the support roller with the coating being on the underside of the web. Thereafter the web has been inverted so that the web is horizontal but the coating is on the upper side of the web, and it is in this orientation that the coating has been set. In accordance with the present invention, a curtain coated web is chilled and set while it is moving substantially horizontally with the coating facing downwards. Some chilling may be performed while the coated web is moving downwards away from the support roller and prior to being turned to the substantially horizontal.

Because it has been thought desirable to set a liquid photographic coating as soon as possible after it is coated onto the web, it might be thought that it would be advantageous to chill and set the coating while it is moving upwards or downwards. However, when a web with a liquid coating thereon is moving in a direction having a vertical component, there is flow of the liquid relative to the web, caused by gravity, and unrelated to the surface irregularities of the web. Such gravity induced flow relative to the web is not uniform through the depth of the coating, for various reasons, such as: the coating may be formed of a plurality of different layers each having a different viscosity; and the Reynolds number is different at different depths of the coating. Also, when being chilled, regions of the coating at different depths into the coating will set at different times because, for example, there will be a temperature gradient in the coating and the materials in different layers set differently. Furthermore, different regions laterally of the coating may set at different times because of uneven chilling laterally of the web. Thus, it has been found that if setting is attempted while the coated web is moving in a direction having a vertical component, regions at some depths and also at some lateral locations of the coating, will set before others. The set regions are immobile and the unset regions continue to flow. This leads to defects in the uniformity of the thickness of the coating in the product, which are usually unacceptable. Thus, while it is possible to start the chilling process while the coated web is moving downwards away from the support roller, the chilling should not be allowed to proceed so far that setting occurs in any portion of the coating while the web is so moving downwardly.

It is desirable to start the chilling as soon as possible after coating. Thus, if the coated web moves downwardly or upwardly away from the support roller, chilling may start during such downwards or upwards movement and before the web is turned to move substantially horizontally with the coating facing downwards, in accordance with the present invention. Furthermore, by dividing the chilling between a downwards or upwards run and the horizontal run, the ratio of the durations for which gravity is firstly ineffective or only partially effective and subsequently effective in relation to opposing surface tension in affecting liquid layer thickness uniformity, is a controlled parameter.

When manufacturing some products, it has been found that it is desirable to perform a substantial portion of the chilling while the web is moving downwards away from the support roller, so that, when the web is turned to a direction of movement which is substantially horizontal with the coating on the underside of the web, in accordance with the present invention, setting occurs very quickly after the turn to the horizontal. The products which benefit from setting occurring very soon after the turn to the horizontal are those in which the coating thickness is uniform at the time of turning.

Other products benefit from the coating being on the underside of the substantially horizontally moving web in an unset condition for a longer time. Such products are those in which the free surface of the liquid materials has partially levelled at the time of turning to the substantially horizontal and there is benefit to be gained from allowing gravity to act on the liquid coating for a greater period of time with the coating on the underside of the substantially horizontal web. For some of such products, it may be most beneficial to have no portion of the chilling occur while the web is moving downwardly. For such products the web may leave the underside of the support roller directly in a substantially horizontal direction with the coating on the underside of the web.

When the coating has been set throughout its depth, and in all regions laterally of the web, drying can, be commenced. Such drying can be effected by directing heated air at the coating with the web still in the substantially horizontal orientation and the coating on the underside; or in any other convenient orientation. For example, the web can be inverted by passage over air turning bars operating at the backside of the web, so that, after inversion the web is moving horizontally and the coating is facing upwards. Drying is conducted in a manner well known in the photographic material manufacturing art.

Embodiments of the present invention will now be described, by way of example, with reference to the accompanying drawings, in which:

DESCRIPTION OF THE PREFERRED EMBODIMENT

Figure 1:
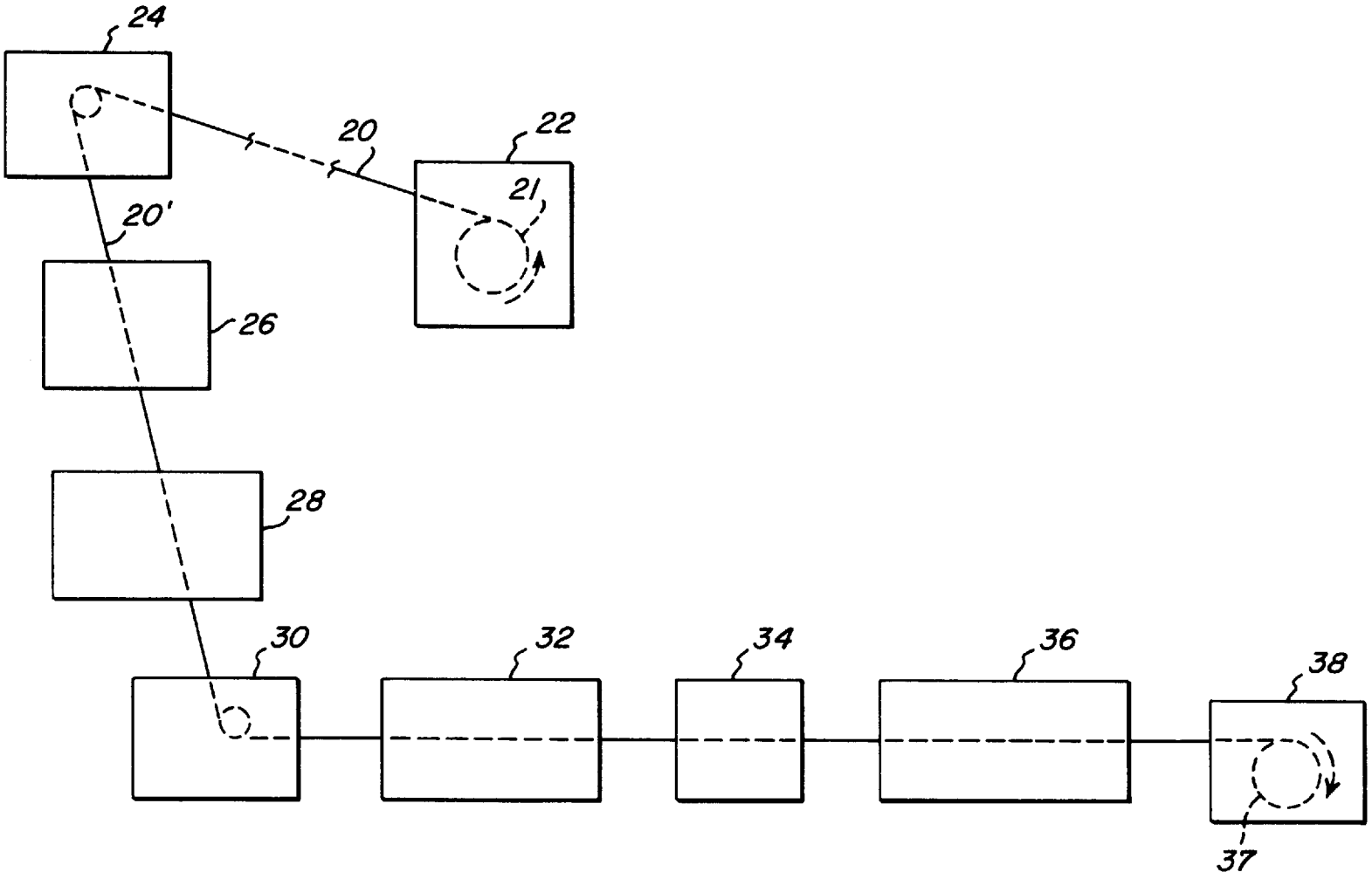
FIG. 1 is a diagrammatic representation of the steps in a method, in accordance with the present invention, for manufacturing coated photographic materials.

FIG. 1 of the accompanying drawings diagrammatically represents the apparatus and steps in a method, in accordance with one embodiment of the present invention, for manufacturing photographic materials. In this embodiment, the web is curtain coated and is moved away from the support roller in a direction having a vertical component and chilling is started while the web is moving downwardly away from the support roller. The materials to be made, in the embodiment being described, are known photographic sensitized film having a cellulose acetate or polyethylene terephthalate support carrying dry layers including sensitized materials. In the method now being described, a web 20 of cellulose acetate film is led from a supply roll 21, at an unwinder station 22, to a coating station 24 at which a layer of liquid photographic material is applied to the web 20 by curtain coating. The coated web 20' leaves the coating station 24 in a downwards direction, inclined to the vertical with the coating facing downwards, and enters an isolation zone 26. After the isolation zone 26, the coated web 20' passes through a chilling zone 28 to a turning station 30 at which it is turned to the substantially horizontal with the liquid material layer on the underside thereof. Now that the coated web is subsatantially horizontal it enters a further chilling zone 32 which it leaves with the coated layer having been set. The material comprising the support with a set layer thereon is then inverted at an inversion station 34, from which it passes to a drier 36.

It is known that in a sensitized photographic film there may be many distinct layers of different materials on the support. Several layers may be applied as a single, composite layer at a coating station. After that single layer has been dried, another layer, itself containing a plurality of distinct layers, may be applied and dried. In the embodiment presently being described, the dried material leaving the drier 36 may be wound up into a roll or it may pass on to a further coating station. Which is the case is not material to the present invention. However, for the purpose of the present description, it is assumed that the layer of material applied at the coating station 24 is the last layer and that the product emerging from the drier is, therefore, fit to be wound up into a roll 37 at a windup station 38 which is represented in FIG. 1.

Assuming that all of the layers needed to form the photographic film are present in the material rolled up at the windup station 38, the roll 37 is subsequently unwound and slit and cut into sheets or strips and packaged in a manner well known in the art and which will not be herein described.

While in FIG. 1 it is illustrated that all of the stations and zones are separated, it is to be understood that some of them are contiguous, as will be apparent from the ensuing detailed description.

Figure 2:
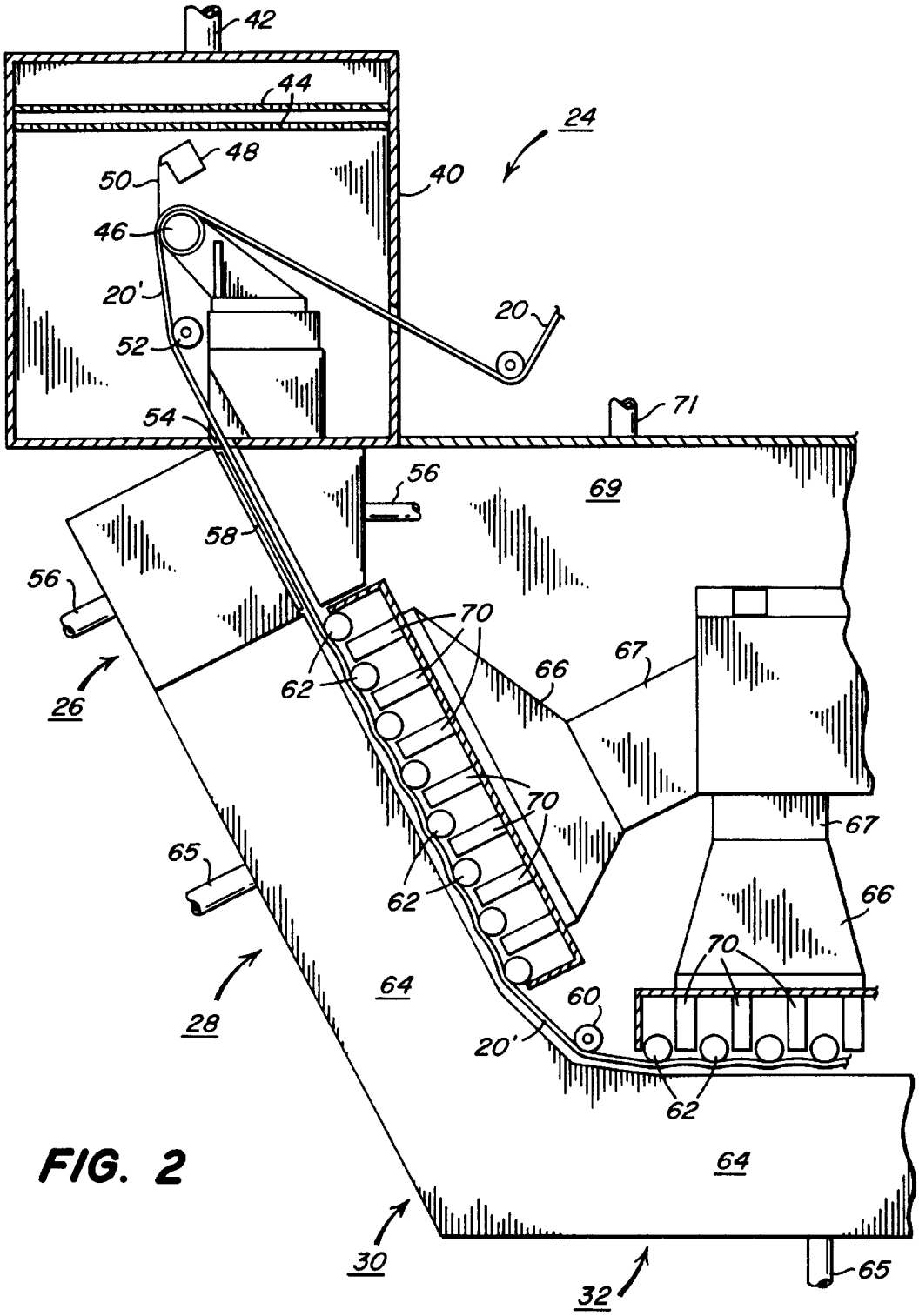
FIG. 2 is a diagrammatic representation of some of the zones and stations represented in FIG. 1.

FIG. 2 represents, and shows more detail of, the coating station 24, the isolation zone 26, the chilling zone 28, the turning station 30 and a portion of the further chilling zone 32.

The coating station 24 includes an enclosure 40, the nature and purpose of which is described in copending U.S. patent application Ser. No. 559,806, now abandoned, filed Jul. 30, 1990 by Finnecum et al and commonly assigned. Filtered air at a temperature of about 40° C. and a Relative Humidity of about 5% is introduced into the enclosure through duct 42. The pressure in the enclosure is supra-atmospheric whereby dust and drafts are excluded from the enclosure. Means for ensuring that the flow of air downwards within the enclosure 40 is uniform and non-turbulent, are diagrammatically represented at 44. Within the enclosure 40 is a support roller 46 which, in known manner, serves to provide a very accurate position in space for the web 20 at the time of application of the liquid material. As is known, the support roller 46 may be driven so as to provide the web 20 with a very accurate speed at the location of application of the liquid material, or it may be an idler with the accurate web speed imposed elsewhere. In the present embodiment the support roller is driven.

Above the support roller 46 is a slide hopper 48, of known form, for converting flows of several different liquid materials into a falling curtain 50 formed of a plurality of contiguous discrete layers of the materials. The hopper 48 is so positioned that the curtain 50 impinges on the web 20 along a line parallel to the axis of rotation of the support roller 46. After impingement on the web, the liquid in the curtain forms a layer having a thickness which is uniform both laterally and longitudinally of the web The liquid layer on the web is thinner than the curtain because the web is moving faster than the curtain.

An idler roller 52 is positioned below the support roller 46 with its axis parallel to that of the support roller 46. The idler roller 52 is provided because the unsupported span of the coated web between the support roller 46 and the next location, in the chilling zone 28, at which the web is supported, is longer than is desirable when the web is carrying a still liquid coating. The roller 52 is so located that the unsupported web spans at both sides of the roller 52 are of acceptably short length. The roller 52 is so located, with its axis parallel to the axis of the support roller 46, that a) the web wraps around the roller for at least 15°; b) the inclination to the vertical, of the web after leaving the roller 52 has a desired value; and c) the web leaving the support roller is in the shade of the support roller relative to the lip of the hopper from which the curtain extends. The last characteristic ensures that should the curtain become so deflected that the liquid materials in it no longer impinge on the web on the support roller, they fall through space and do not impinge on the web after it has left the support roller. Upon leaving the roller 52, in the present embodiment, the web is moving downwardly, is inclined to the vertical at an angle of 32° and the coating facing downwards. The isolation zone 26 and the chilling zone 28 are so positioned relative to the idler roller 52 that the coated web can travel at the desired inclination of 32° to the vertical.

The enclosure 40 has an aperture 54 in its bottom through which the coated web passes out of the enclosure 40 and away from the coating station 24. Upon passing through the aperture 54, the web passes directly into the isolation zone 26. The isolation zone is the subject of U.S. patent application Ser. No. 703447 filed simultaneously herewith, now abandoned, in the names of R. Jongsma, L. R. Lammes, G. J. Lewis and R. A. Wahlers and with the title Apparatus and Method for Coating a Continuous Web and commonly assigned. The disclosure of that application is specifically incorporated herein by reference. The isolation zone serves to isolate the air in the enclosure 40 from the air in the chilling zone 28. The atmosphere in the enclosure 40 is at a pressure slightly above atmospheric and is warmer, at 40° C., and has a dew point of 8°–10° C. which is higher than the temperature in the chilling zone 28. If the enclosure 40 were to be contiguous with the chilling zone 28 and it being inevitable that there is an opening for passage of the coated web, there would be condensation as the atmosphere from the enclosure 40 entered the chilling zone. Such condensation might result in condensate forming on equipment which might cause subsequent defects in the coated web. Other condensate might come to rest directly on the coated web. The presence of such condensate on the coated web would create defects. However, the isolation zone 26 prevents such condensation and defects. Air at 24° C. and 9% RH is introduced into the isolation zone 26 through ducts 56 and is exhausted from the isolation zone so that any atmosphere carried from the isolation zone 26 into the chilling zone has such low dew point that there is no condensation. The isolation of the chilling zone 28 from the enclosure 40 is further enhanced by the fact that the warmest air is uppermost and the coolest air is lowermost, whereby convection effects aid in effecting isolation. If the idler roller 52 can be positioned close to the aperture 54 providing for passage of the coated web 20' from the enclosure 40 to the isolation zone 26, it will partially block the aperture 54 and it will serve also to reduce the amount of air entrained with the web travelling from the enclosure to the isolation zone 26, thereby further reducing the chances of condensation.

The isolation zone 26 includes means, such as perforated screens, diagrammatically represented at 58, for ensuring that air flow within the isolation zone adjacent the liquid coating on the web is not such as to adversely affect the uniformity of thickness of the coating. More specifically, the means 58 keeps the maximum velocity of air impinging on the coating low enough, and renders the velocities of air impinging on the coating uniform enough, that the surface of the liquid is not deformed and there is no differential cooling.

Contiguous with the isolation zone 26 is the chilling zone 28. In the present embodiment, the chilling zone 28, the turning station 30 and the further chilling zone 32 are integral. In both the chilling zone 28 and the further chilling zone 32 the coating is chilled while the web and its coating are constrained to move along a path which, overall, is rectilinear. The first overall rectilinear path in the chilling zone 28 is inclined at the aforesaid angle of 32° to the vertical, with the coating facing downwards, and in the further chilling zone 32 the second overall rectilinear path is substantially horizontal, with the coating facing downwards. The web is turned from the first to the second substantially rectilinear path by the turning station 30 which includes a roller 60.

Figure 3:
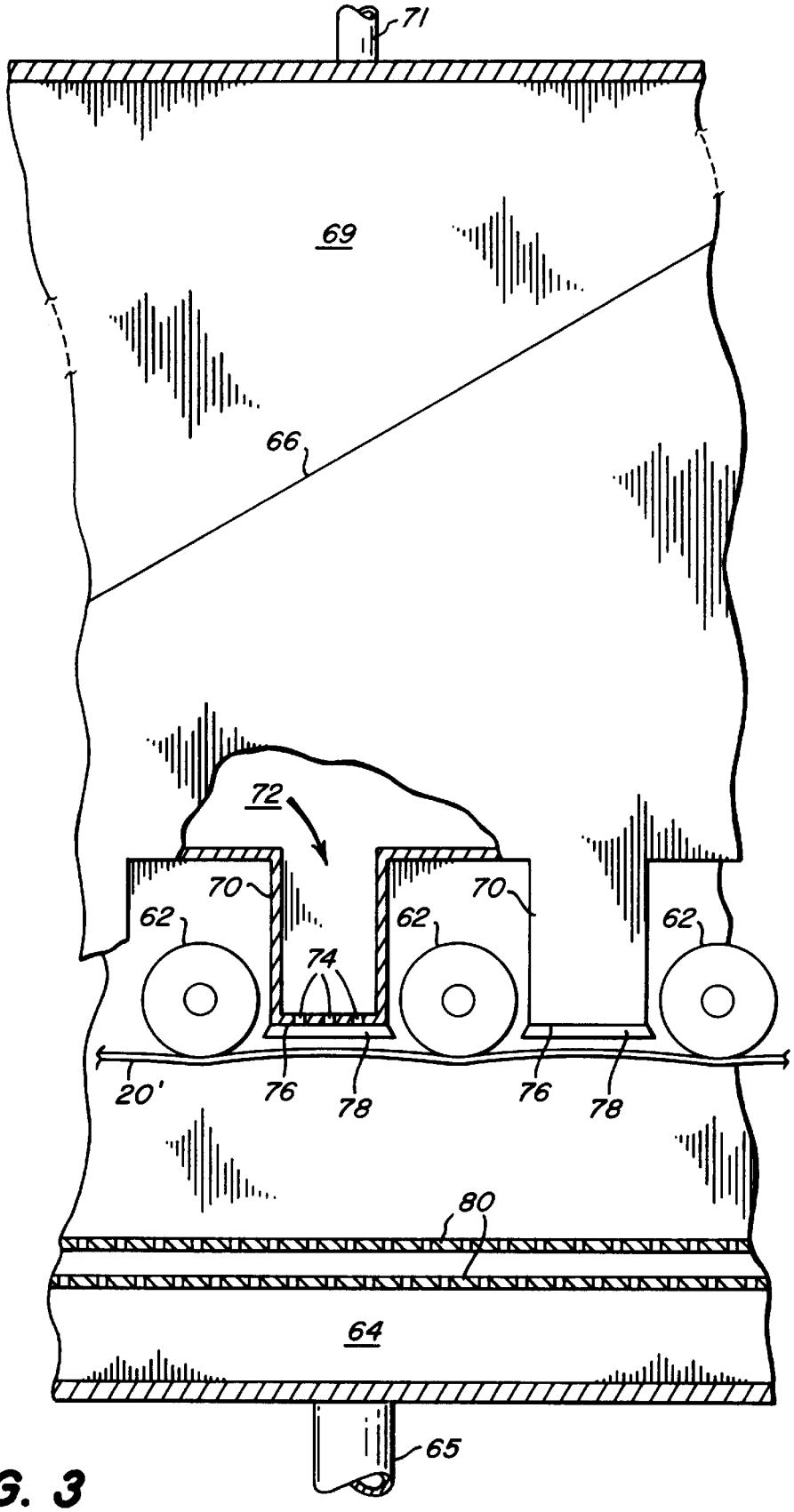
FIG. 3 is a diagrammatic representation of a portion of a chilling zone included in the apparatus represented in FIG. 2.

The two chilling zones 28 and 32 are of a known and similar construction and a brief description of one of them will suffice for both. The two chilling zones are generally of a form described in U.S. Pat. No. 4,231,164 issued on Nov. 4, 1980 to Eugene H. Barbee, the disclosure of which is specifically incorporated herein by reference. Reference is now made to FIG. 3 which schematically represents a portion of a chilling zone. In the chilling zones there are a plurality of rollers 62 uniformly spaced apart and with parallel axes. In the chilling zone 28 the axes of the rollers are disposed in a common plane inclined to the vertical at the aforementioned angle 32°. In the further chilling zone 32 the axes of the rollers 62 are disposed in a common substantially horizontal plane. The coated web 20' is held against the rollers 62 by a pressure differential on the surfaces of the web. Chilled air is introduced into a plenum 64 which is located at the coated side of the web 20, through duct 65. At the backside (that is, the non-coated side) of the web 20' there is a plenum 69. Air is withdrawn from the plenum 69 through duct 71 (indicated schematically) by a return fax (not shown) which causes recirculation to the ducts 67 of a portion of the air. A portion of the air is not recirculated in order to keep solvent, etc. content of the air to a proper level. Between the rollers 62 there are air bars 70. In FIG. 3 one of the air bars 70 is shown in section and the other is shown in end view. As can be seen in FIG. 3, the air bars 70 are, in essence, rectangular section ducts the upper sides of which are open to plenum 66. Air is supplied to plenum 66 through duct 67. The wall 76 of each duct-like air bar 70 which faces the web 20' has a plurality of apertures 74 to allow flow of air from the air bar 70 onto the backside of the web 20'. On the perforated, web-facing wall 76 of each air bar 70 there are a plurality of fins 78 which are planar and in parallel planes perpendicular to the web 20' and parallel to the direction of web movement.

Chilled air is supplied to the air bars 70 through the ducts 67 and plenums 66 and flows onto the backside of the web 20' through the apertures 74 which direct the chilled air at the back of the web and thereby maximize the heat flow from the web to the air. The fins 78 serve to control the chilled air to flow over the web in directions parallel to the direction of web movement web movement, prior to flowing into the plenum 66. In flowing to the plenum 69, the air is caused by the presence of the air bars 70 to flow over the surfaces of the rollers 62, thereby chilling the rollers 62. Thus, heat is withdrawn from the backside of the web 20' in two ways, namely directly to air impinged onto it by the air bars and also by contact with the rollers 62. Having flowed over the rollers 62, the air flows through the spaces between the rollers 62 and the plenum 66 to the plenum 69 surrounding the plenum 66.

Chilled air introduced into the plenum 64 is prevented from impinging on the coating in a deleterious manner by air flow smoothing means which are omitted from being illustrated in FIG. 2, for the sake of clarity, but are illustrated in FIG. 3 as being a plurality of stacked foraminous screens 80, although any device known for creating air flow rate uniformity over an area may be adopted.

It is arranged that the air pressure on the coated side of the web 20' is greater than the air pressure on the backside of the web so that the web is held against the rollers 62 and has a wrap of about 30°–45° around each roller. Such a wrap has the advantage of increasing the contact time and hence increasing the loss of heat to each roller and the additional advantage of ensuring that each roller is turned by the web and that the web is not dragged across the roller. If the web were to be dragged over a roller, each successive area of the web passing the roller would not contact a freshly chilled portion of the roller surface.

The liquid coating on the web is chilled in the chilling zone 28 but care is taken, for reasons stated above, that no portion of the coating actually sets before the web turns at the turning station 30, that is, before the web passes around the roller 60. While the web is moving downwardly with the coating facing downwards, as is the case during the time it is travelling from the support roller 46 until it has passed around the roller 60, the liquid coating is flowing relative to the web under the influence of gravity. This, per se, is normal and acceptable. However, as explained above, if some depth-wise or lateral portion of the coating were to be allowed to set before other depth-wise or lateral portions of the coating, then there would be relative flow between the set and the unset portions which would lead to unacceptable defects in the product. Thus, it is imperative that there be no setting before the web reaches the turning roller 60.

After turning to the substantially horizontal, the web with the chilled but still liquid coating thereon, enters the further chilling zone 32. In the embodiment being specifically described, the plenum 64 on the underside of the web 20 is continuous from the chilling zone 28 into the further chilling zone 32. However, the plenum 64 could be discontinuous at the turning station or elsewhere.

The further chilling zone 32 is long enough that it can successfully set even that product which needs the longest chilling before setting, after turning to the substantially horizontal. The selection of the point on the substantially horizontal run of the web where setting starts to occur is, as described above, dependent on the nature of the product and may be selected experimentally or determined by calculation.

The chilling zone 28 is long enough that any product which is enhanced if setting is initiated just after turning onto the substantially horizontal run, can be accommodated. When products are being made on apparatus which has a long chilling zone 28, which products have best quality if setting occurs only after a substantial time in substantially horizontal condition, the temperature of the air supplied to the backside of the web in the chilling section 28 is adjusted, in fact, raised, in order to achieve such delayed setting even though, with a lower temperature, the chilling zone 28 could perhaps have so chilled the coating that setting occurred just after turning onto the substantially horizontal.

In those portions of the further chilling zone 32 which are downstream of the point where total chill setting of the coating has been achieved, the temperature of the air supplied to the backside of the web may be selected to avoid further chilling and to reap a saving in energy costs.

After having been fully set in the further chilling zone 32, the web with the set coating thereon passes out of the zone 32' and passes through the inversion station 34. In the inversion station, the web 32 is inverted by passage around one or more air turning bars which are of known form and of which a detailed description will not be given herein. An air turning bar comprises a tubular member to the interior of which air is supplied under pressure. The tubular member has holes through its walls which allow air to escape from the interior of the member. The escaping air forms an air bearing under a web travelling over the apertured surface of the bar. The turning bars are located at the backside of the web so that the coating is away from the bar.

With the coating now on the upperside of the web 20, the web and set coating move on to the drier 36 which, being of known form, will not be further described herein. After being dried, the web and coating thereon move on to the windup station 38 wherein the web is wound into the roll 37.

Details of the chilling zone and of its operation not specifically described above may be taken from the art.

The web is moved along its path not only by the driven support roll 46 but also by additional drive rollers throughout the machine.

In operation, web 20 is drawn off the roll 21 at the unwinder station 22 and is led around the support roll 46. Air is being introduced into the top of the enclosure 40 through the duct 42 and its flow down through the enclosure is rendered uniform by the means 44. Liquid materials are being supplied to the hopper 48 and are flowing therefrom in the form of the curtain 50. The curtain contains a plurality of contiguous discrete layers, often, but not always, equal in number to the number of materials. The curtain impinges on the web which is moving at a speed greater than that of the curtain. Thus, the layer of liquid materials is thinner than the curtain but is of uniform thickness both laterally of the web and with time, that is, longitudinally of the web. The coated web moves away from the support roller 46 towards the isolation zone 26 and the chilling zone 28. The web is not supported in the isolation zone 26 but is supported in the chilling zone 28. The web 20' is supported in the span between the support roll 46 and the first roller 62 in the chilling zone 28, by the idler roller 52.

The coated web 20' passes out of the enclosure 40 through the aperture 54. Because the pressure in the enclosure is supra-atmospheric, in order to keep dust and drafts away from the coating liquid, some warm moist air flows with the web. Such warm moist air is prevented by the isolation zone 26 from entering the chilling zone 28.

The coated web 20' passes on to the chilling zone 28 wherein it is chilled towards setting but no setting occurs.

The amount of chilling which occurs in the chilling zone 28, or, in other words, the proximity of the coating to setting when it arrives at the roller 60 which serves to turn the web to the substantially horizontal, is predetermined for each product and is controlled by the temperature and volume of air introduced into the chilling zone 28 and by the speed of the web. Thus, when the coated web 20' turns to the substantially horizontal and enters the further chilling zone 32, it has a predetermined proximity to setting. With such a predetermined proximity to setting and with the temperature and rate of supply of air to the further chilling zone controlled, and with the speed of the web controlled, the length of time that the coated web is moving substantially horizontally in the further chilling zone before it sets, is predetermined and controlled. The length of time before setting is determined for each different product and, as mentioned above, is dependent on whether it is desirable to have a longer or a shorter time during which the force of gravity is acting against surface tension forces in influencing the surface of the liquid coating. It has to be taken into consideration that as the temperature of the coating decreases so the viscosity of the coating increases. Thus, temperature of the coating is another variable available for use in achieving the objective of gaining a uniform thickness of coating. For example, it may be advantageous for the viscosity to be relatively low when the web enters its substantially horizontal run; so that gravity may have more effect than if the viscosity were higher. After the liquid material has been set, the web continues moving through the further chilling zone and is further chilled before it leaves the further chilling zone 32 and is inverted in the inversion station 34 and is then dried in the drier 36 and is wound up into roll 37 in the windup station 38.

As is known to those skilled in the art, the temperatures induced in the liquid coating in the chilling zone 28 and the further chilling zone 32 should not be such as to cause freezing of components of the coating. Thus, the air supplied to the chilling zone 28 may be colder than that supplied to at least the initial portion of the further chilling zone 32. This may be so because the liquid coating while in the chilling zone 28 is at a higher temperature than it is in the initial portion of the further chilling zone 32 and heat can be drawn from it faster than when its temperature is close to that at which setting starts. To achieve the difference in temperatures in the two chilling zones, they may be so constructed that their air supplies and flows within them are separate and of different temperature.

As is known to those skilled in the art, the length of time it takes to set a liquid coating is dependent on the temperature of the coating, the rate at which the temperature is lowered, and on the setting time constant of the coating. The setting time constant of a coating liquid containing gelatin is inversely proportional to the third power of the gelatin concentration in the liquid. Thus, a coating liquid with twice the amount of gelatin will set, that is gel, in one eighth of the time. From a knowledge of the setting time constant of the coating, the heat capacity of the coated web, the heat transfer coefficient, and the temperature of the cooling air, it is possible to predict the setting time of the coating.

The angle of inclination of the web to the vertical during chilling and prior to being turned to the substantially horizontal, is determined by a desire to have the web in the shadow of the support roller relative to the coating hopper lip and by the desire wrap of the web around the roller 52. Further than that, it is determined by constraints imposed by other aspects of the design of the coating station. While in the embodiment being specifically described the angle of inclination to the vertical during chilling and prior to turning to the horizontal is 32°, it is to be understood that the angle could be anywhere in the range of 0° to 90°.

The angle of wrap of the web 20' around the rollers 62 is determined by the pressure differential on the two surfaces of the coated web and by the tension in the web. The greater the angle of wrap the greater is the heat transfer to the rollers 62. However, the pressure differential should not be such that the web is pressed into contact with the air bars 70. Ideally, the wrap of the coated web around the rollers 62 is in the range of about 20° to 60°.

Figure 4:
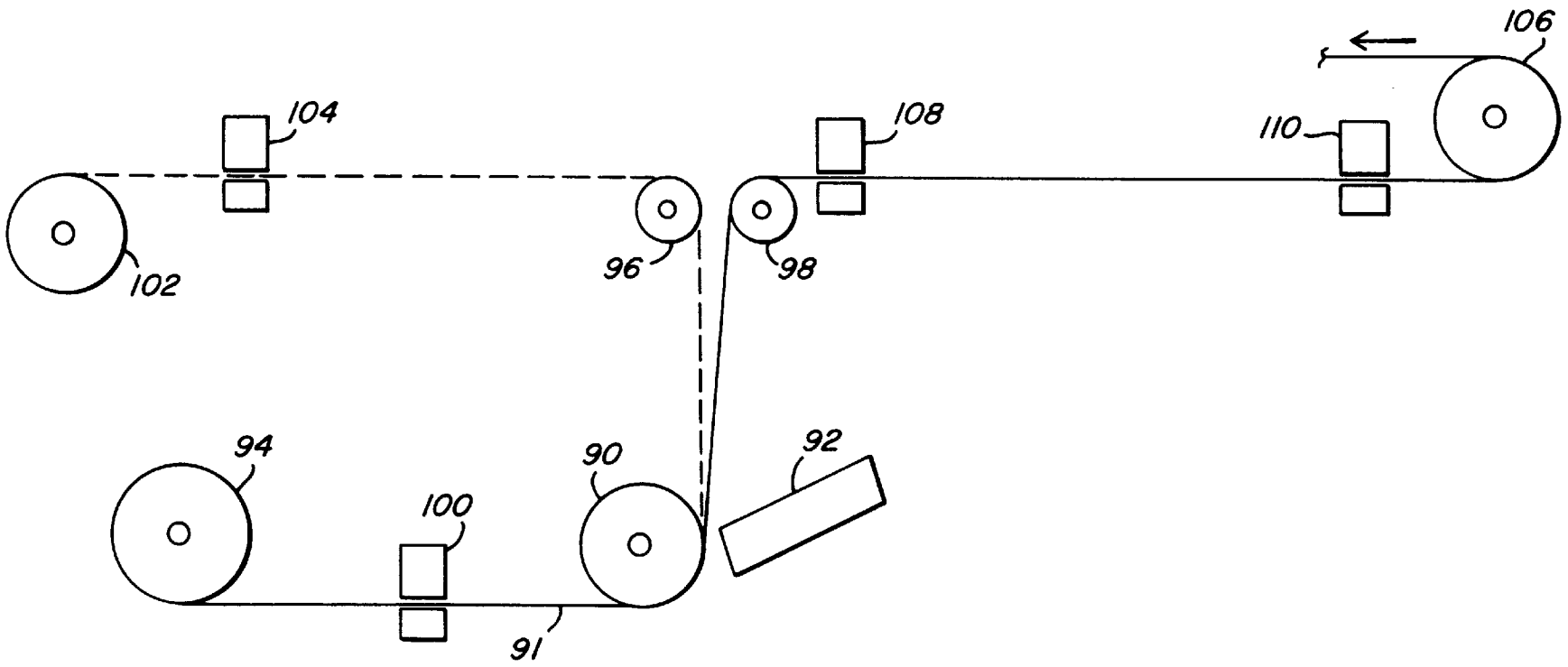
FIG. 4 is a diagrammatic representation of an apparatus for demonstrating an effect related to the present invention.

FIG. 4 represents a test apparatus for comparing the effects on coating uniformity with the coated web travelling substantially vertically upwards after coating and then horizontally with, in one case, the coating facing upwards and, in the other case, the coating facing downwards (to the left as seen in, FIG. 4 and to the right as seen in FIG. 4, respectively). The test apparatus represented in FIG. 4 includes a support roller 90 and a bead coating slide hopper 92. The path of a web 91 towards the support roller 90 is defined by a roller 94. The path of the web away from the support roller is defined by a roller 96 for the coating upwards tests and by an undercut or edge conveyance roller 98 for the coating downwards tests.

The web approaching the support roller has had coated onto it, and dried, a transparent layer which varies semi-sinusoidally in thickness so as to form a web having a non-planar surface. The web with -the coating thereon has an optical density of about 0.1 which varies with the thickness of the coated web. Such thickness is derived from the signals from a first scanner 100 which senses optical density variations in the web 91 as it approaches the support roller. Such optical density variations are an indication of thickness variations of the web. The non-planar surface faces downwards as the coated web approaches the support roller and it is to this surface that the hopper 92 applies a uniform coating of a liquid having a viscosity similar to that of liquid materials coated in photographic coating operations. The liquid coated onto the coated web includes a dye such that the optical density of the coating is about 1.1.

The test apparatus has no chilling capability and therefore represents a worst case situation. It was mentioned above that as the length of time during which the liquid material is subjected to chilling increases so the viscosity of the liquid material increases. As the viscosity increases so the displacement per unit time of liquid material under the influence of gravity and surface tension imbalance, decreases. In the test equipment there is no chilling so the response of the liquid material to gravity and surface tension imbalance remains constant and does not decrease with time.

For tests with liquid material facing upwards on the horizontal web, the coated web was led over the roller 96 so that it had a substantially vertical path between the support roller 90 and the roller 96 followed by a horizontal path onwards from the roller 96 to the roller 102 during which the coating was facing upwards. A second scanner 104 was located at a known distance from the roller 96 along the horizontal run. The roller 96 was at a known distance from the support roller 90. Thus, the distances of the roller 96 from the support roller 90 and the distance of the scanner 104 from the roller 96 being known and the speed of the web being known, the time, $T_v$, for a point on the web to travel from the point where it is coated vertically to the roller 96 and the time, $T_{hu}$, for the same point to travel from the roller 96 to the scanner 104, are both readily derivable. Such times are variable by varying the speed of the web. When the web speed is varied the coating thickness is kept the same by varying proportionately the flow rate through the hopper.

For tests with liquid material facing downwards on the horizontal web, the coated web was led over the roller 98 so that it had a substantially vertical path between the support roller 90 and the roller 98 followed by a horizontal path onwards from the roller 98 to the roller 106 along which the coating was facing downwards. A third scanner 110 was located at a known distance from the roller 98 along the horizontal run. The roller 98 was at a known distance, the same as the roller 96, from the support roller 90. Thus, the distances of the roller 98 from the support roller 96 and the distance of the third scanner 110 from the roller 98 being known and the speed of the web being known, the time, $T_v$, for a point on the web to travel from the point where it is coated vertically to the roller 98 and the time, $T_{hd}$, for the same point to travel from the roller 98 to the third scanner 110, are both readily derivable. Such times are variable by varying the speed of the web. When the web speed was varied the coating thickness was kept the same by proportionately varying the flow rate through the hopper.

Immediately after the roller 98 there is a fourth scanner 108, which is very close to the roller 98 and is used for taking density readings of the web and coating at that location. Being very close to the roller 98, the readings taken by fourth scanner 108 are regarded as being taken at the top of the vertical run of the web.

Each of the scanners 100, 104, 108 and 110 senses optical density of the web and coating (in the case of 104, 108 and 110) passing in front of it. With the positions of the scanners known, the instantaneous density reading can be associated with a position on the web as it passes through the test device.

The web has a design optical density of 0.1. The liquid material being fed to the hopper for coating on the web has a degree of opacity such that a coating of predetermined thickness put down on the web has an optical density of 1.1.

Figure 5:
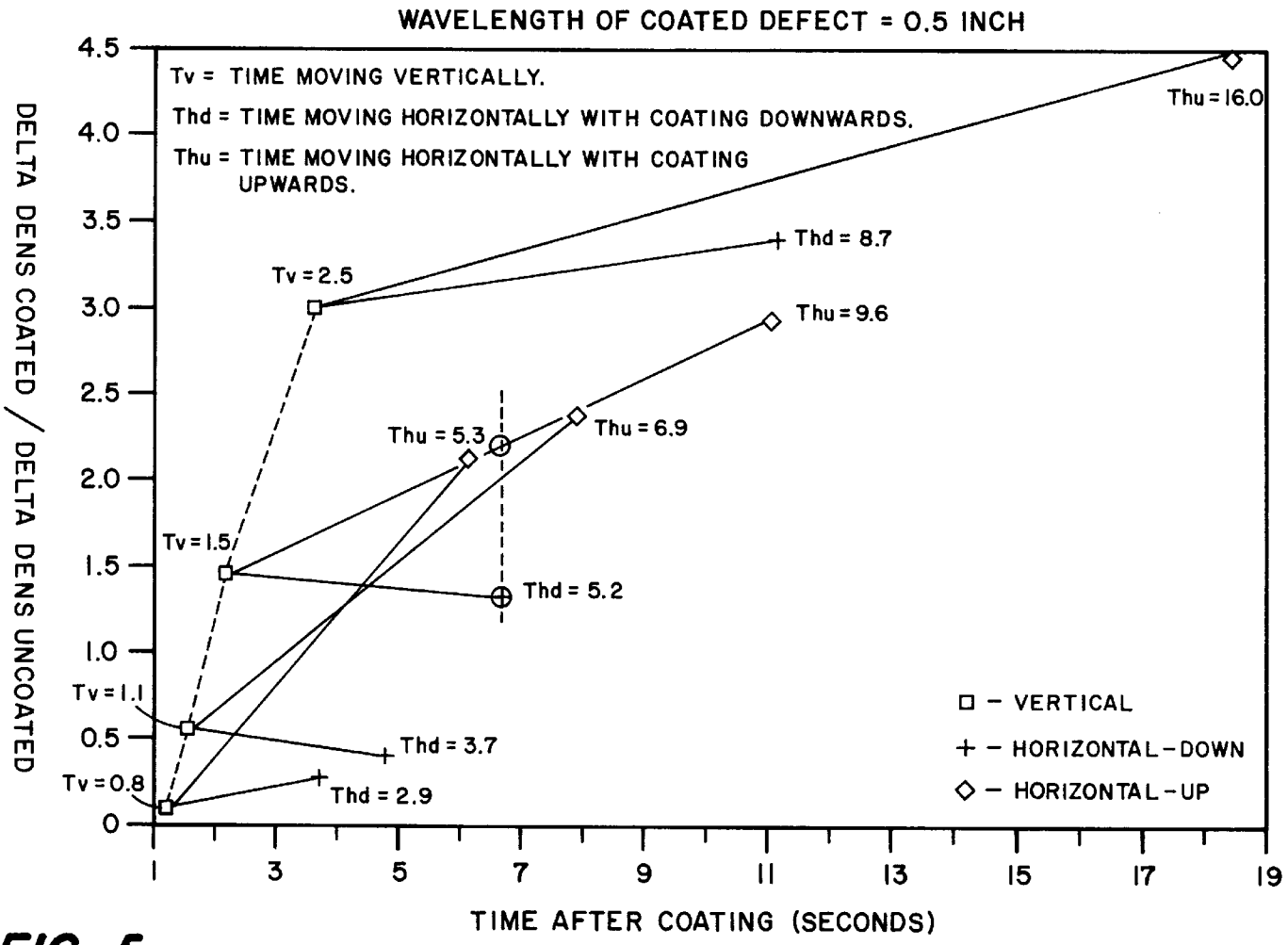
FIGS. 5 and 6 are plots of measurements made with the apparatus represented in FIG. 4.
Figure 6:
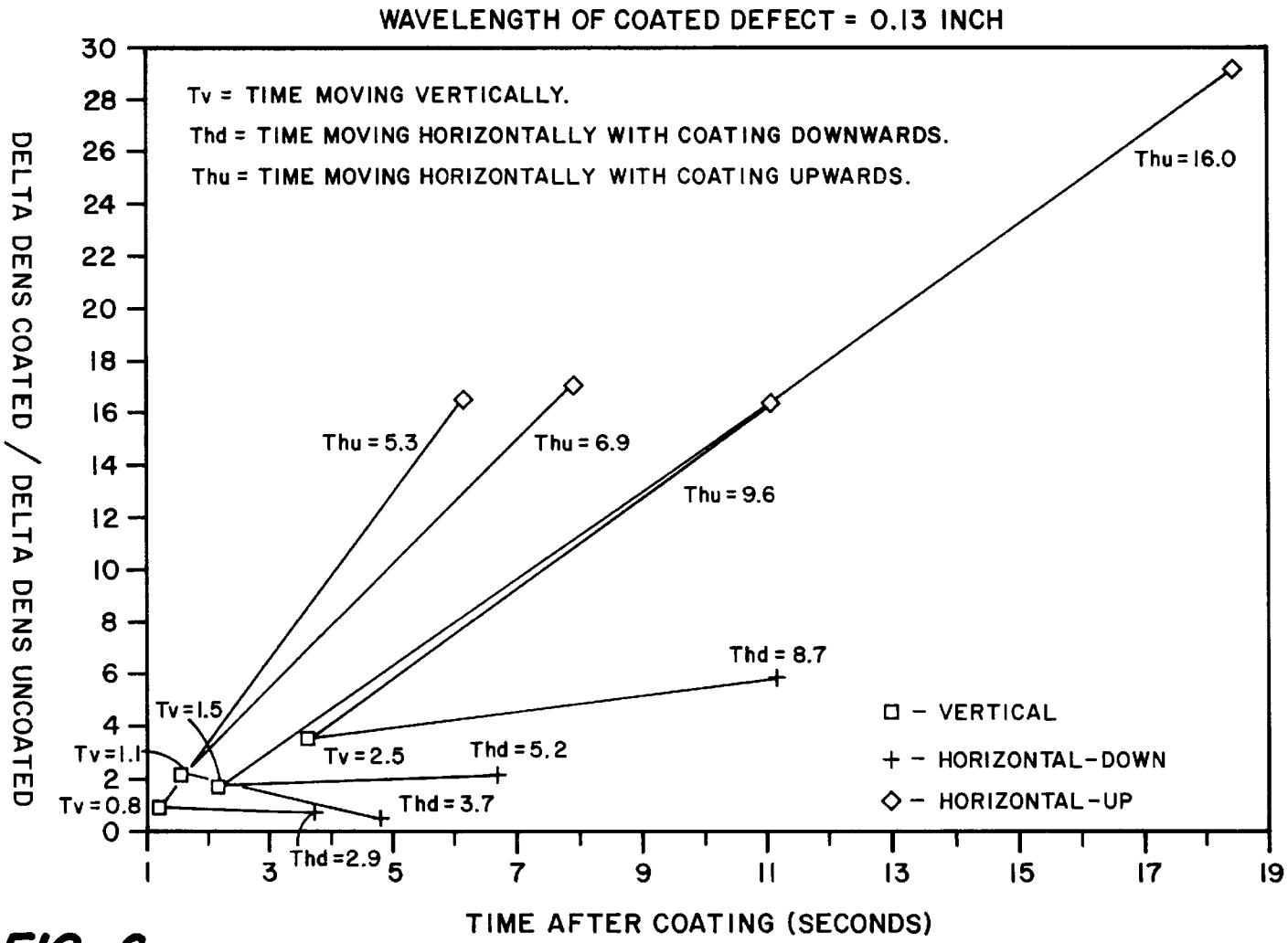

FIGS. 5 and 6 are plots of results for tests with webs having two different wavelengths of the semi-sinuspidal surface deformation of the dried coating on the web prior to arrival at the support roller 90. The two different wavelengths were 0.5 inch (FIG. 5) and 0.13 inch (FIG. 6). Each plot is of ratio of the magnitude of the variation in optical density with (deltadc) and without (deltad) the coating applied by the hopper 92. Thus, the lower the value of that ratio, the less is the flow of the liquid after coating.

It will be seen that in each of the two plots, readings were taken for four durations of vertical movement, namely $T_v$=0.8; 1.1; 1.5; and 2.5 seconds. From each plotted point for $T_v$ two lines extend, one connecting to a value of $T_{hd}$ (duration on horizontal run with coating downwards) and the other to a value of $T_{hu}$ (duration on horizontal run with coating upwards). Measurements were taken at:

$T_v$=0.8; $T_{hd}$=2.9

$T_v$=1.1; $T_{hd}$=3.7

$T_v$=1.5; $T_{hd}$=5.2

$T_v$=3.5; $T_{hd}$=8.7

$T_v$=0.8; $T_{hu}$=5.3

$T_v$=1.1; $T_{hu}$=6.9

$T_v$=1.5; $T_{hu}$=9.6

$T_v$=3.5; $T_{hu}$=16.0

An indication of the improvement achieved by moving the liquid coated web horizontally with the liquid coating facing downwards as opposed to facing upwards can be gained from the vertical distance between the two lines extending from the same $T_v$ point. As an example, a vertical broken line has been drawn in FIG. 5 through the point $T_{hd}$=5.2 after 1.5 seconds of vertical movement. It will be observed that the improvement in deltadc/deltad is about 0.9, (i.e., 2.2–1.3) and the ratio of the two values of $\delta d_c/\delta d$ is 1.69.

Again, it is pointed out that in these tests there was no chilling and the results from them are good only for showing that there is less of a thickness uniformity change if the liquid coating is on the underside when the coated web is travelling horizontally.

In one particular embodiment of the present invention the following parameters existed:

viscosity of coated liquid at coating: 40 cp inclination of coated web to vertical between support roller 46 and idler roller 52: 10° inclination of coated web to vertical from roller 62 to roller 60: 32° time from coating to turning to horizontal: 1.5 secs.

time on horizontal before setting is complete: 0.75 secs.

temperature of air introduced into chilling zone 28: −4° C.

temperature of air introduced into chilling zone 32: +2° C.

duration of chilling after setting: 4.2 secs.

air incoming into the coating enclosure 40: 40° C. and −9° C. dew point;

air incoming into isolation zone 26: 24° C. and −9° C. dew point;

While in the embodiment described above, the duration of chilling before setting while the web is substantially horizontal with the coating on the underside in accordance with the present invention, is short, for example 0.75 secs., it is to be understood that the invention is not limited to such short periods of chilling before setting while the web is moving substantially horizontally. While it is believed that for most liquid materials it is advantageous to cause setting very soon after the web has turned to substantially horizontal, either directly from the support roller or after a downwardly inclined path, the invention is applicable also to those instances in which there is a benefit to be gained from longer durations before setting with the web moving substantially horizontally and with the coating facing downwards.

While in the embodiment specifically described above, the web initially after coating is inclined at an angle of 10° to the vertical and then moves at an inclination of 32° to the vertical prior to turning to move substantially horizontally, it is to be understood firstly that it is not essential to the present invention to change the inclination to the vertical at some intermediate point. Furthermore, the web may move along a substantially horizontal path directly from the underside of the support roller, in accordance with the present invention.

In the embodiments specifically described above, the liquid material is applied to the support web by slide hopper curtain coating. It is to be understood that the invention is also applicable in extrusion coating and in slide hopper bead coating.

Several alternative embodiments of the present invention will now be described, with reference to FIGS. 7, 8 and 9. In the ensuing description, only those features will be described which differ from features of the embodiment described above with reference to FIGS. 1 to 3. It is to be understood that for features not described in the ensuing description, reference should be had to the description above or to the prior art. In the ensuing descriptions, features corresponding to features described above will be given the same reference numerals but with the addition of suffixes a (for the embodiment illustrated in FIG. 7), b (for the embodiment illustrated in FIG. 8), and c (for the embodiment illustrated in FIG. 9). For a full understanding of such features, reference should be had to the description above.

Figure 7:
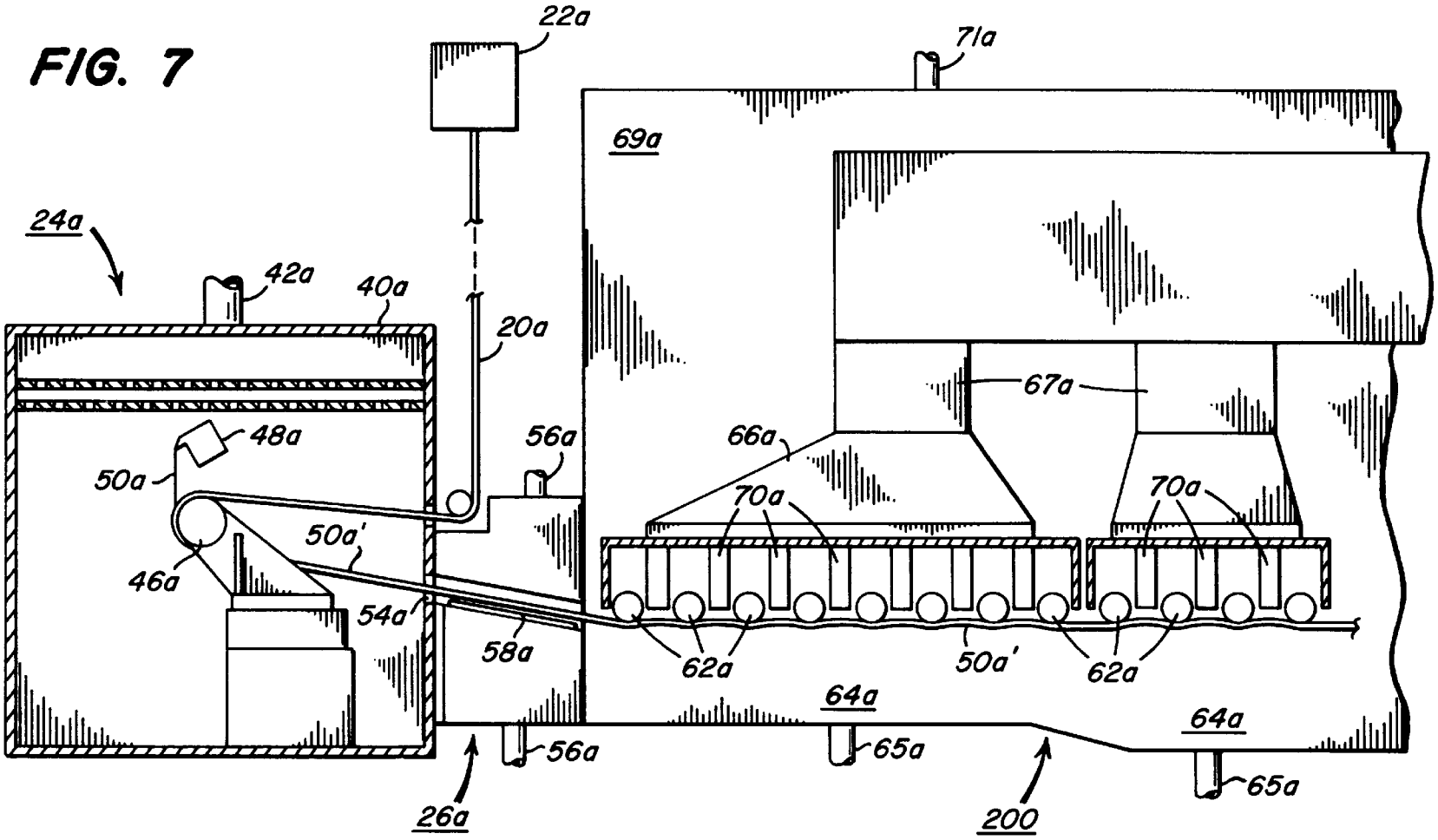
FIG. 7 is a diagrammatic representation, similar to FIG. 2, but illustrating a second embodiment of the present invention.

FIG. 7 illustrates a portion of apparatus, in accordance with the present invention, for curtain coating a web 20*a*, for leading the coated web substantially horizontally away from the underside of the support roller 46*a*, and for chilling and setting the downwardly facing coating on the substantially horizontally moving web. The coated web 50*a*' leaves the enclosure 40*a* through the aperture 54*a* which is located in a side wall of the enclosure. The coated web upon passing through the aperture 54*a* enters the isolation zone 26*a* and then enters a chilling and setting zone 200. The chilling and setting zone 200 is generally similar to the chilling zone 28 and the further chilling zone 32, except that the axes of the rollers 62*a* are disposed in a common substantially horizontal plane so that the general path of the coated web for the entire time from leaving the support roller 46*a* until the time of setting is substantially horizontal. Only a portion, the upstream portion, of the setting and chilling zone 200 is illustrated. It is to be understood that its length is determined for individual products to be manufactured. The time which elapses between coating and setting is determined to minimize the defects due to surface imperfections of the web and is variable, by varying the rate of chilling. Usually the sooner setting occurs, the better. However, it will be recognized that the benefits attributable to the present invention are being achieved in that gravity is opposing surface tension effects.

Figure 8:
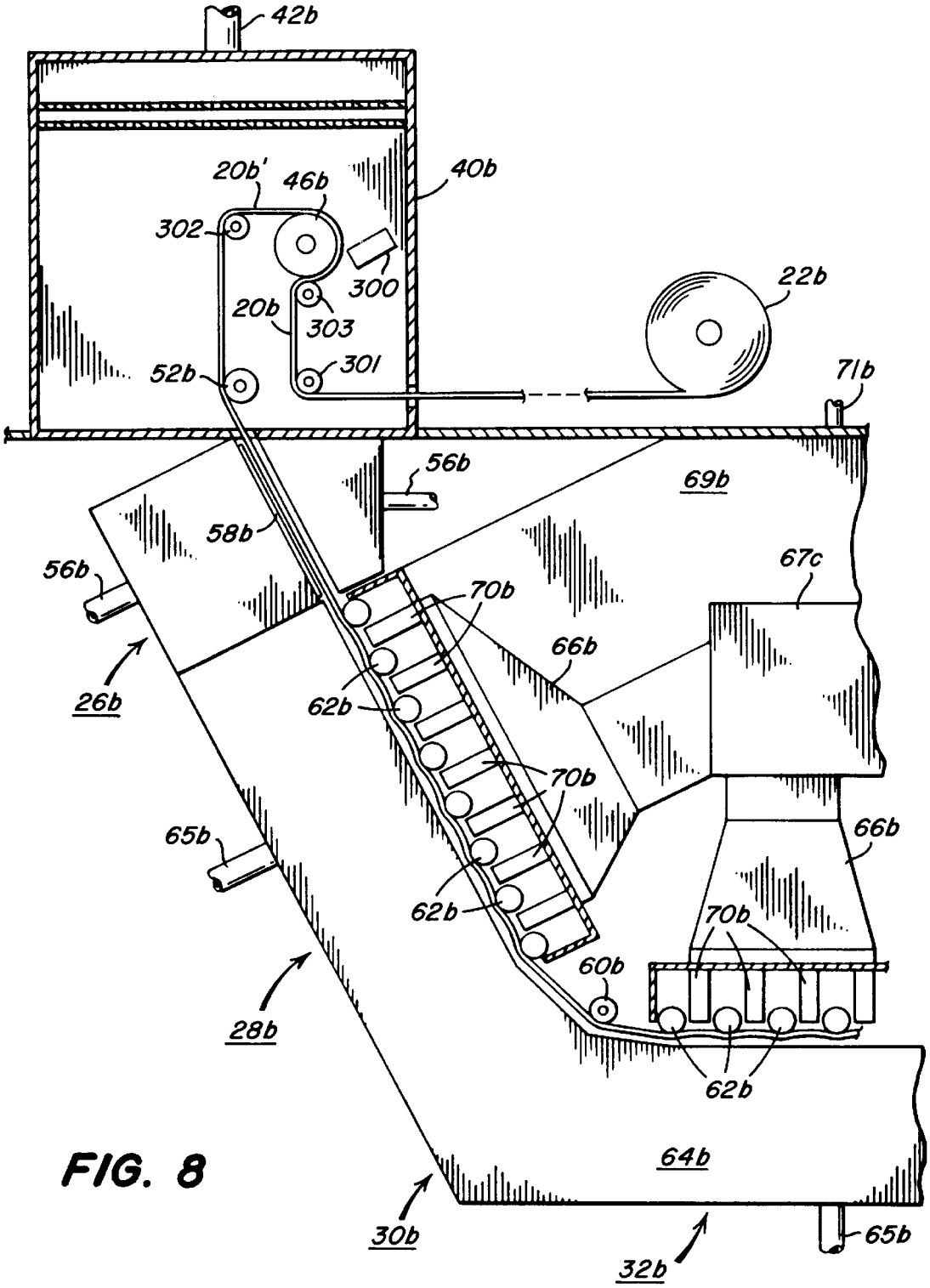
FIG. 8 is similar to FIG. 7 but illustrates a third embodiment of the present invention.

FIG. 8 illustrates a third embodiment of the present invention. In this third embodiment the liquid materials are coated onto the web by bead coating. In FIG. 9, a slide hopper 300 is illustrated in position adjacent the support roller 46*b* appropriate for bead coating. The web 20*b* is brought vertically upwards to the support roller 46*b*, guided by rollers 301 and 303, and is wrapped around it for about 150°. The coated web 20*b*' is led horizontally away from the support roller 46*b*, and is turned through 90° by a roller 302 so that it moves vertically downwards to the roller 52*b*. After leaving the roller 52*b*, the coated web passes through an aperture 304 in the coating room floor 306 and enters the isolation zone 26*b*. Upon leaving the isolation zone 26*b* the coated web 20*b*' directly enters the chilling zone 28*b* on its way to the roller 60*b* which serves to turn the web onto the substantially horizontal with the coating facing downwards. After passing around the roller 60*b* the web is in the further chilling zone 32*b* (only a portion of which is shown in FIG. 8) in which the coating is further chilled and, at some selected time after coating, is set. After leaving the roller 52*b* and before turning at the roller 60*b*, the coated web is moving downwards at an angle of about 32° to the vertical.

Figure 9:
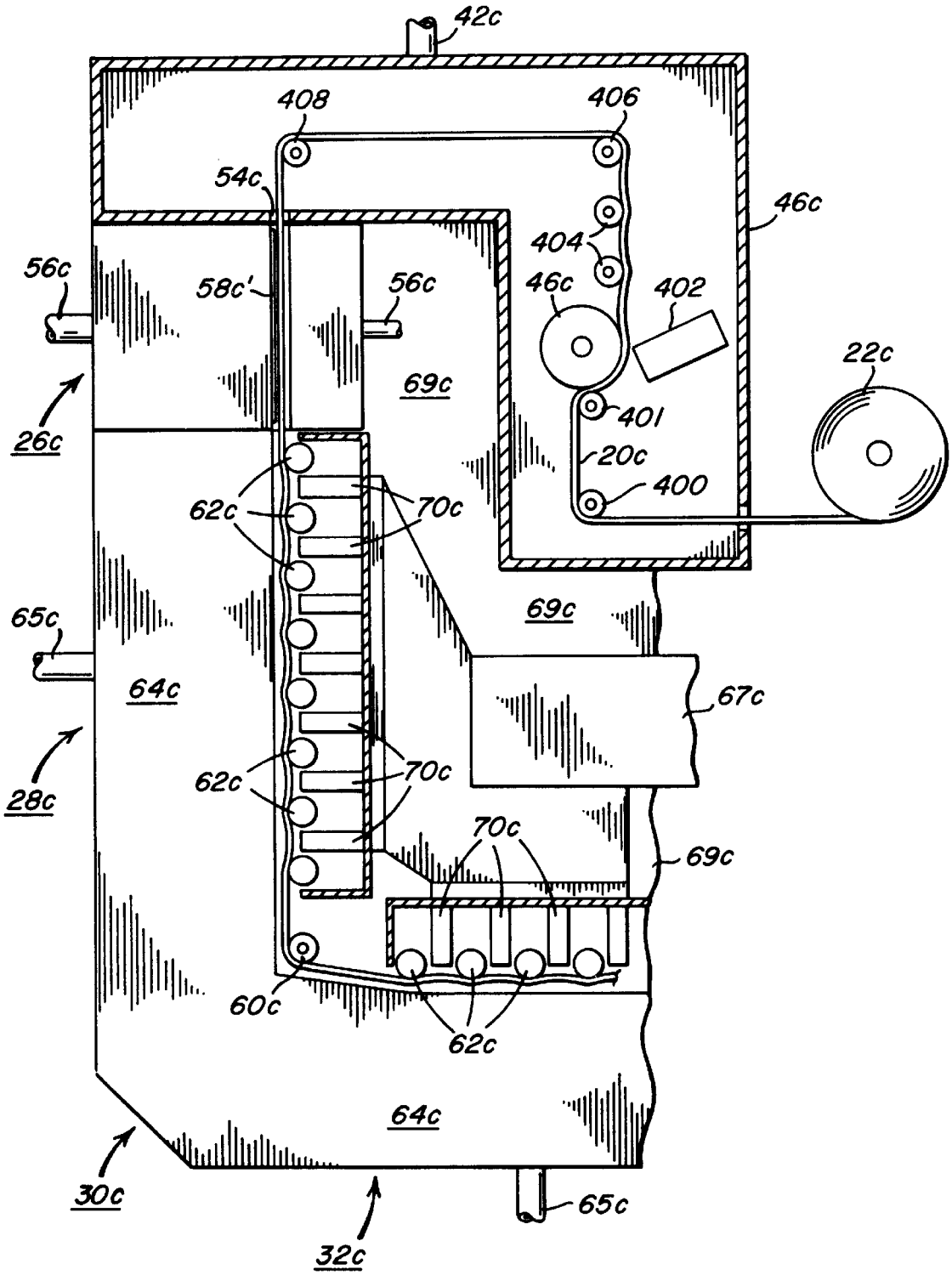
FIG. 9 is similar to FIGS. 7 and 8, but illustrates a fourth embodiment of the present invention.

A fourth embodiment of the invention, illustrated in FIG. 9, is intended for bead coating. A web 20*c*, to be coated, is led vertically upwards from a turning roller 400 to a roller 401 which guides the web onto the support roller 46*c* and serves to increase the wrap angle on the roller 46*c*. Adjacent the support roller 46*c* is a slide hopper 402. After being coated, the web 20*c*' is led vertically upwards by a succession of rollers 404 to a turning roller 406 which turns the web to the horizontal with the coating facing upwards. The coated web is kept in contact with and caused to wrap partially around, the rollers 404, and the web is caused to wrap partially around the support roller 46*c*, by a pressure differential created, in known manner, on its two faces. The means for creating the pressure differential are not shown in FIG. 9 but include plenums at both sides of the web and means for creating a greater pressure in the plenum at the coated side of the web than at the uncoated side.

At the end of the substantially horizontal run, leading from the roller 406, the length of which is determined by the structural requirements of the machine, the web is turned, by roller 408, to move vertically downwards. As soon as is feasible after leaving the turning roller 408, the coated web enters the isolation zone 26*c*. Immediately upon leaving the isolation zone 26*c*, the coated web 20*c*, enters the chilling zone 28*c* which it leaves at the turning station 30*c* by turning from the vertical to the substantially horizontal around the roller 60*c*. At the turning station 30*c* the coated and chilled web enters the further chilling zone 32*c* (only a portion of which is illustrated in FIG. 9) in which it is further chilled and set. After leaving the chilling zone the coated web is dried and wound up as previously described. Thus, in the embodiment illustrated in FIG. 9, the web is bead coated and is moved vertically downwards while being chilled before being turned to the substantially horizontal with the coating facing downwards, for further chilling and setting. The ratio of the time spent being chilled while moving vertically to the time spent being chilled and moving substantially horizontally with the coating facing downwards, before setting, is discretionary and chosen so as to provide best results.

In the embodiments specifically described above the web is positioned at the coating position by a support roller. It is to be understood that other forms of means for positioning the web for receiving the liquid photographic materials may be adopted within the scope of the present invention. For example, a continuous belt may be used for positioning the web. It has also been proposed to coat a web while it is moving between two rollers and is under tension.

The invention has been described in detail with particular reference to preferred embodiments, but it will be understood that variations and modifications can be effected within the spirit and scope of the invention as described.

What is claimed is:

1. A method of manufacturing coated photographic materials comprising:

feeding a support web through a bead coating position;

applying liquid photographic materials to the support web while at said bead coating position whereby a layer of uniform thickness is formed on the web, said liquid, photographic layer including material which is gelable by chilling;

moving the web with the layer of material thereon in a substantially horizontal direction with the photographic materials facing downwards; and chilling said liquid materials while said web is substantially horizontal with the materials on the underside thereof whereby the liquid materials gel.

2. A method as claimed in claim 1, including the steps of:

moving the web with the layer of liquid photographic materials thereon vertically downwards prior to the said step of moving the web with the layer of materials thereon in a substantially horizontal direction with the materials facing downwards; and chilling the materials while moving the web vertically downwards.

3. A method as claimed in claim 1, including the steps of:

moving the web with the layer of liquid photographic materials thereon in a downwards direction, with the photographic materials facing downwards, prior to the said step of moving the web with the layer of materials thereon in a substantially horizontal direction with the photographic materials facing downwards; and chilling the materials while moving the web downwards.

4. A method as claimed in claim 1, wherein:

the web with the layer of liquid materials thereon is moved along a path inclined at 32° to the vertical during chilling and prior to being turned to the substantially horizontal.

5. A method as claimed in claim 1, wherein the coating position includes a support roller about which the web is wrapped and the step of moving the web in a substantially horizontal direction is initiated as the web leaves the support roller.

6. A method as claimed in claim 1, including:

creating a space around said bead coating position wherein the pressure is above atmospheric; and preventing atmosphere from passing with the web from said space to the zone where chilling occurs.

7. A method as claimed in claim 1, including the further steps of:

leading the web with the layer of materials thereon away from the coating position in a generally horizontal direction;

turning the web with the coating thereon so that it moves downwards; and thereafter turning the web to the substantially horizontal as a precursor to the said step of moving the web with the layer of materials thereon in a substantially horizontal direction with the photographic materials facing downwards.

8. A method as claimed in claim 7 including:

chilling the materials on the web while the web is moving downwards prior to being turned to move substantially horizontally.

9. A method as claimed in claim 1, including the step of:

leading the web with the materials thereon upwards away from the coating position;

turning the web so that the web moves horizontally and the liquid photographic materials on the web face upwards;

turning the web so that the web moves downwards; and subsequently, as a precursor to the said step of moving the web with the layer of materials thereon in a substantially horizontal direction with the layer of materials facing downwards, turning the web to the substantially horizontal.

10. A method as claimed in claim 1, wherein the web when being moved substantially horizontally with the layer of liquid materials facing downwards has an inclination to the horizontal of 20° or less.

11. A method as claimed in claim 1, wherein the web when being moved substantially horizontally with the layer of liquid materials facing downwards has an inclination to the horizontal of 10° or less.

12. A method as claimed in claim 1, wherein the web when being moved substantially horizontally with the layer of liquid materials facing downwards has an inclination to the horizontal of 5° or less.

* * * * *